US008424526B2

(12) United States Patent
Dolezal

(10) Patent No.: US 8,424,526 B2
(45) Date of Patent: Apr. 23, 2013

(54) HOLDER FOR A NASAL BREATHING AIR FILTRATION DEVICE OR DILATION DEVICE

(75) Inventor: David M. Dolezal, Scottsdale, AZ (US)

(73) Assignee: AirWare, Inc., Scottsdale, AZ (US)

( * ) Notice: Subject to any disclaimer, the term of this patent is extended or adjusted under 35 U.S.C. 154(b) by 491 days.

(21) Appl. No.: 12/650,945

(22) Filed: Dec. 31, 2009

(65) Prior Publication Data

US 2010/0199994 A1 Aug. 12, 2010

Related U.S. Application Data

(60) Provisional application No. 61/142,282, filed on Jan. 2, 2009.

(51) Int. Cl.
*A61G 10/00* (2006.01)

(52) U.S. Cl.
USPC ..... 128/206.11

(58) Field of Classification Search ..... 128/205.29, 128/206.11, 203.22, 207.18, 206.12, 206.14
See application file for complete search history.

(56) References Cited

U.S. PATENT DOCUMENTS

| | | | |
|---|---|---|---|
| 480,505 | A | 8/1892 | Midgley et al. |
| 533,880 | A | 2/1895 | Forne |
| 701,538 | A | 6/1902 | Carence |
| 813,425 | A | 2/1906 | Hill |
| 1,071,015 | A | 8/1913 | Adler |
| 1,175,799 | A | 3/1916 | Niessner |
| 1,322,375 | A | 11/1919 | Un |
| 1,508,890 | A | 9/1924 | Lasseaux |
| 1,520,930 | A | 12/1924 | Calhoun |
| 1,823,094 | A | 9/1931 | Dylong |
| 2,046,664 | A | 7/1936 | Weaver |
| 2,057,397 | A | 10/1936 | Strauch |
| 2,097,846 | A | 11/1937 | Strauch |

(Continued)

FOREIGN PATENT DOCUMENTS

| | | | |
|---|---|---|---|
| CN | 2236341 | Y | 10/1996 |
| CN | 2250782 | Y | 4/1997 |

(Continued)

OTHER PUBLICATIONS

T. J. O'Meara, et al., "The reduction of rhinitis symptoms by nasal filters during natural exposure to ragweed and grass pollen", Allergy 2005: 60: 529-532.

(Continued)

*Primary Examiner* — Theodore Stigell
(74) *Attorney, Agent, or Firm* — Winthrop & Weinstine, P.A.

(57) ABSTRACT

A holder for a nasal air filtration device or dilation device. A holder for a nasal device may be a thin, generally "Z" or "S" shaped device that holds a nasal device in a substantially secure and stable position. Each of a nasal device's nasal bases can be placed or secured on a placement limb of the holder while a connecting member of the nasal device can be secured on the opposite side of the holder from where the nasal bases are positioned along a vertical portion of the holder relative to the placement limbs. There may be securing notches in the holder that help secure a nasal device at generally the point where the bases of the nasal device attach to the connecting member of the nasal device. The notches may allow a nasal device to be securely attached to the holder.

19 Claims, 7 Drawing Sheets

U.S. PATENT DOCUMENTS

| | | | | |
|---|---|---|---|---|
| 2,151,227 | A | 3/1939 | Pawelek | |
| 2,162,583 | A | 6/1939 | Kjellsson | |
| 2,277,390 | A | 3/1942 | Crespo | |
| 2,433,565 | A | 12/1947 | Korman | |
| 2,535,155 | A | 12/1950 | Pandorf | |
| 2,672,138 | A | 3/1954 | Carlock | |
| 2,751,906 | A | 6/1956 | Irvine | |
| 2,777,442 | A | 1/1957 | Zelano | |
| 2,890,695 | A | 6/1959 | Safstrom | |
| 3,451,392 | A | 6/1969 | Cook et al. | |
| 3,457,917 | A | 7/1969 | Mercurio | |
| 3,463,149 | A | 8/1969 | Albu | |
| 3,722,509 | A | 3/1973 | Nebel | |
| 3,747,597 | A | 7/1973 | Olivera | |
| 3,884,223 | A | 5/1975 | Keindl | |
| 3,905,335 | A | 9/1975 | Kapp | |
| 4,030,491 | A | 6/1977 | Mattila | |
| 4,052,983 | A | 10/1977 | Bovender | |
| D251,017 | S | 2/1979 | Amezcua | |
| 4,220,150 | A | 9/1980 | King | |
| 4,221,217 | A | 9/1980 | Amezcua | |
| 4,267,831 | A | 5/1981 | Aquilar | |
| 4,327,719 | A | 5/1982 | Childers | |
| 4,401,117 | A | 8/1983 | Gershuny | |
| 4,573,461 | A | 3/1986 | Lake | |
| 4,984,302 | A | 1/1991 | Lincoln | |
| 5,117,820 | A | 6/1992 | Robitaille | |
| 5,392,773 | A * | 2/1995 | Bertrand | 128/206.11 |
| 5,417,205 | A | 5/1995 | Wang | |
| 5,568,808 | A | 10/1996 | Rimkus | |
| 5,746,200 | A | 5/1998 | Draenert | |
| 5,775,335 | A | 7/1998 | Seal | |
| 5,787,884 | A | 8/1998 | Tovey | |
| 5,890,491 | A | 4/1999 | Rimkus | |
| 6,015,425 | A | 1/2000 | Altadonna, Jr. | |
| 6,109,262 | A | 8/2000 | Tovey | |
| D430,667 | S | 9/2000 | Rome | |
| 6,119,690 | A | 9/2000 | Pantaleo | |
| 6,183,493 | B1 | 2/2001 | Zammit | |
| 6,213,121 | B1 | 4/2001 | Cardarelli | |
| 6,216,694 | B1 | 4/2001 | Chen | |
| D451,193 | S | 11/2001 | McCormick | |
| 6,386,197 | B1 | 5/2002 | Miller | |
| 6,484,725 | B1 | 11/2002 | Chi | |
| 6,494,205 | B1 | 12/2002 | Brown | |
| 6,557,278 | B1 | 5/2003 | Huang | |
| 6,561,188 | B1 | 5/2003 | Ellis | |
| 6,584,975 | B1 | 7/2003 | Taylor | |
| 6,701,924 | B1 | 3/2004 | Land, Jr. et al. | |
| 6,962,156 | B2 | 11/2005 | Michaels | |
| 6,971,387 | B2 | 12/2005 | Michaels | |
| 6,971,388 | B1 | 12/2005 | Michaels | |
| 6,978,781 | B1 | 12/2005 | Jordan | |
| 7,156,098 | B2 | 1/2007 | Dolezal et al. | |
| D571,457 | S | 6/2008 | Dolezal et al. | |
| D572,360 | S | 7/2008 | Dolezal et al. | |
| D572,361 | S | 7/2008 | Noce | |
| D575,397 | S | 8/2008 | Noce | |
| D595,848 | S | 7/2009 | Dolezal et al. | |
| 2003/0106555 | A1 | 6/2003 | Tovey | |
| 2003/0106556 | A1 | 6/2003 | Alperovich et al. | |
| 2003/0136409 | A1 | 7/2003 | Seo | |
| 2003/0209145 | A1 | 11/2003 | Soper | |
| 2004/0055603 | A1 | 3/2004 | Bruce | |
| 2004/0079814 | A1 | 4/2004 | Altadonna, Jr. | |
| 2004/0194784 | A1 | 10/2004 | Bertrand | |
| 2004/0211425 | A1 | 10/2004 | Wang | |
| 2004/0261798 | A1 | 12/2004 | Rimkus | |
| 2005/0061325 | A1 | 3/2005 | Michaels | |
| 2005/0066972 | A1 | 3/2005 | Michaels | |
| 2005/0066973 | A1 | 3/2005 | Michaels | |
| 2005/0205095 | A1 * | 9/2005 | Dolezal et al. | 128/206.11 |
| 2005/0211250 | A1 | 9/2005 | Dolezal et al. | |
| 2008/0023007 | A1 | 1/2008 | Dolezal et al. | |
| 2008/0099021 | A1 | 5/2008 | Moore | |
| 2009/0007919 | A1 | 1/2009 | Dolezal et al. | |

FOREIGN PATENT DOCUMENTS

| | | |
|---|---|---|
| DE | 201 01 539 U1 | 7/2001 |
| DE | 202 06 514 | 8/2002 |
| EP | 1 340 522 A2 | 9/2003 |
| JP | S49-94491 | 8/1974 |
| JP | S52-164394 | 12/1977 |
| JP | S55-148761 | 10/1980 |
| JP | S60-171450 | 11/1985 |
| JP | S61-228883 | 10/1986 |
| JP | 1-160572 | 6/1989 |
| JP | H2-126668 | 10/1990 |
| WO | WO 99/11326 | 3/1999 |
| WO | WO 01/41629 | 6/2001 |
| WO | WO 2005/092004 | 10/2005 |
| WO | WO 2007/139890 | 12/2007 |

OTHER PUBLICATIONS

Medical Device Company Focused Initially on Preventing Hay Fever, The University of Sydney Business Liaison Office, Commercialisation; Forum & Fair of Ideas; Sydney Mar. 26-28, 2003.

Merriam-Webster Online Dictionary definition of "machine" (http://merriam-webster.com/dictionary/machine), Apr. 8, 2010.

Derwent Pat-No. JP401160572A; Document Identifier; JP 01160572 A; Jun. 23, 1989, Tate, Pollen Protection tool for nose, abstract.

Webster's New World Dictionary, Third College Edition, 1988, p. 155 & 1438 definitions for body and tubular.

"Nose Filters, Better Breathers", Better Breathers™ [retrieved on Sep. 14, 2010] Retrieved from http://www.betterbreathers.com/index.html.

"Breathing Allergy Relief / Allergy Relief Pregnancy", Breathe-Ezy Nasal Filters®, [retrieved on Sep. 14, 2010], Retrieved from http://breathe-ezy.com.au/.

"SHS Nose Filters Ring", Diamond Life Group, [retrieved on Sep. 14, 2010], Retrieved from http://www.diamondlife.net.au/product.

* cited by examiner

HOLDER FOR A NASAL BREATHING AIR FILTRATION DEVICE OR DILATION DEVICE

FIELD OF THE INVENTION

The present disclosure relates to a holder for a nasal breathing air filtration or dilation device. Particularly, the present disclosure relates to a holder that holds and protects a nasal filtration or dilation device during packaging, shipping, storage, and/or handling. More particularly, the present disclosure relates to a holder that secures the bases of a nasal filtration or dilation device on placement limbs, and secures the bridge of a nasal device on an opposite side of the holder from where the bases are positioned.

BACKGROUND OF THE INVENTION

Nasal breathing air filtration devices filter breathed air, reducing inhaled quantities of particulates and contaminants such as dust and pollen. Nasal dilator devices may be inserted into the nasal cavities to expand the nasal breathing cavities, providing for greater and meliorated nasal breathing. For example, U.S. Pat. No. 7,156,098, entitled "Breathing Air Filtration System," U.S. application Ser. No. 11/077,784, entitled "Breathing Air Filtration System," U.S. application Ser. No. 11/238,672, entitled "Breathing Air Filtration Devices," U.S. application Ser. No. 12/022,728, entitled "Breathing Air Filtration Devices," Design Pat. No. D595,848, Design Pat. No. D571,457, Design Pat. No. D572,360, and Design Appl. No. 29/330,276, each of which is hereby incorporated by reference herein in its entirety, disclose various embodiments of nasal air filtration devices or dilation devices suitable for use with the holder of the present disclosure. See also, U.S. Pat. No. 216,694, Chen, and U.S. Pat. No. 2,433,565, Korman, each of which is also hereby incorporated by reference herein in its entirety, and provide further examples of nasal air filtration devices or dilation devices suitable for use with the holder of the present disclosure. Generally, a nasal device may have two generally elliptically-shaped bases connected by a connecting member or bridge. A base may be inserted into each nasal cavity, while the connecting member may remain outside of the nasal cavities. A connecting member may provide for easy insertion and removal of a nasal device and may also keep the nasal bases separated a desired distance. A nasal device may generally be made of any suitable flexible hypo-allergenic material. A nasal device may be made to be used one time, multiple times, over a short period of time, or over a relatively long period of time.

Because of the typically flexible nature of such nasal devices, the devices may become damaged during packaging, shipping, storage, and/or handling, if care is not taken to avoid such damage. For example, the nasal device may be torn, damaged, broken, become twisted or otherwise deformed, or be contaminated during any step of packaging, shipping, storage, and/or handling.

Accordingly, there is a need in the art to package a nasal device in a manner that keeps it from twisting or becoming damaged or broken during packaging, shipping, storage, and/or handling. Further, a need exists to protect a nasal device during periods when it is not being used.

BRIEF SUMMARY OF THE INVENTION

The present disclosure relates to a holder for a nasal breathing air filtration device or a nasal dilator device. In one embodiment of the present disclosure, a holder for a nasal device may be a thin, generally "Z" or "S" shaped device that holds a nasal device in a substantially secure and stable position. Each of a nasal device's nasal bases can be placed or secured on a placement limb of the holder while a connecting member of the nasal device can be secured on the opposite side of the holder from where the nasal bases are positioned along a vertical portion of the holder relative to the placement limbs. There may be securing notches in the holder that help secure a nasal device at generally the point where the bases of the nasal device attach to the connecting member of the nasal device. The notches may allow a nasal device to be securely attached to the holder.

In further embodiments, some nasal devices could be made to be used one time (e.g., single use) or to be used several times (e.g., multiple use). Accordingly, multiple nasal devices may be packaged and sold together. Each nasal device attached to a nasal holder may be individually packaged in a pouch that is heat sealed. Several pouches may be packaged together in a box or other storage container or system, such as a larger pouch, bag, carton, etc. For instance, one box may contain, for example, fourteen individually packaged nasal devices, each attached to holders, or any other suitable number of individually packaged nasal devices, each attached to holders. A holder can be sized and shaped to fit any size of nasal device.

When a nasal device is secured to a holder, the nasal device may be prevented from twisting or becoming damaged. Further, a nasal device may be easier to remove from packaging when it is secured to a holder because there is more surface area to grab onto, and the nasal device may be prevented from twisting while being removed from the packaging. Further, a nasal device could be attached to a holder between uses to protect the nasal device when it is not in use.

In one embodiment, the present disclosure relates to a holder for a nasal device having a top surface, a bottom surface, two sides, and two ends. The holder has a perimeter connecting the sides and ends, and forming a notch to removably secure the nasal device to the holder, such that a portion of the nasal device is secured proximate the top surface of the holder and a portion of the nasal device is secured proximate the bottom surface of the holder.

In another embodiment, the present disclosure relates to a combination nasal device and nasal device holder. The nasal device includes two bases and a connecting member connecting the two bases. The holder includes a perimeter defining a notch for releasably receiving the connecting member and securing the bases of the nasal device proximate a first side of the holder and the connecting member proximate a second side of the holder.

In yet another embodiment, the present disclosure relates to a combination nasal device and nasal device holder. The nasal device includes two bases and a connecting member connecting the two bases. The holder includes a perimeter defining a body portion and two placement limbs for releasably receiving the bases of the nasal device.

BRIEF DESCRIPTION OF THE DRAWINGS

While the specification concludes with claims particularly pointing out and distinctly claiming the subject matter that is regarded as forming the various embodiments of the present disclosure, it is believed that the disclosure will be better understood from the following description taken in conjunction with the accompanying Figures, in which:

DETAILED DESCRIPTION

Figure 1:
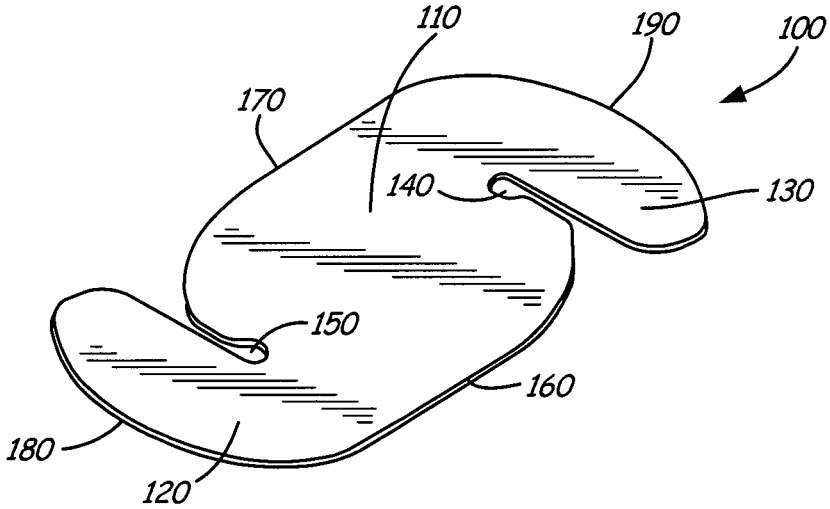
FIG. 1 is a perspective view of a holder for a nasal filtration or dilation device in accordance with one embodiment of the present disclosure.

The present disclosure relates to novel and advantageous holders for a nasal breathing air filtration or dilation device. A holder for a nasal device may allow a nasal device to be securely and stably held in order to keep a nasal device from becoming, for example, twisted, damaged, broken, etc. during packaging, shipping, storage, and/or handling.

A nasal breathing air filtration or dilation device may be made of any hypo-allergenic material such as, for example, polyvinyl chloride (PVC) or polyurethane, or any other suitable material. A nasal device may be structurally self-supporting and further may be flexible and compliant so that it readily conforms to the anterior surface of the nose, in particular the anterior nares and septum, when a nasal device is in use. A nasal device may generally include two base members, one for each nasal cavity, and a connecting member or bridge coupled to the bases to maintain the bases generally spaced apart from one another a desired distance. Each of the bases may be annular—more precisely, generally annular in the sense that its profile may be somewhat elliptical rather than circular, such that it may generally conform to the shape of the nasal cavity. A connecting member may be relatively narrow to provide bending flexibility along the bridge. A filtration device may or may not be provided within the inner annular perimeter of the bases. As recited above, each of U.S. Pat. No. 7,156,098, entitled "Breathing Air Filtration System," U.S. application Ser. No. 11/077,784, entitled "Breathing Air Filtration System," U.S. application Ser. No. 11/238,672, entitled "Breathing Air Filtration Devices," U.S. application Ser. No. 12/022,728, entitled "Breathing Air Filtration Devices," Design Pat. No. D595,848, Design Pat. No. D571,457, Design Pat. No. D572,360, Design Appl. No. 29/330,276, U.S. Pat. No. 216,694, Chen, and U.S. Pat. No. 2,433,565, Korman, each of which was previously incorporated by reference herein, disclose various embodiments of nasal air filtration devices or dilation devices suitable for use with the holder of the present disclosure.

In general, a holder for a nasal device may be a thin, generally "Z" or "S" shaped device that holds a nasal device in a secure and stable position. A holder for a nasal device may be made from a strong-grade paper material, plastic, metal, any other suitable material, or any combinations thereof. In some embodiments, a holder may be made using a thermoplastic, such as but not limited to a polyethylene terephthalate. A holder may be made using any suitable manufacturing process or technique, such as but not limited to injection molding, now known or later discovered for the material selected. Additionally, a holder could be made of any color desirable. Similarly, a holder for a nasal device may have any degree of thickness and/or flexibility, ranging from stiff and rigid to very flexible and pliable, such that a nasal device may be secured to the holder. Each of the nasal bases of a nasal device may be placed on a placement limb of a holder while the connecting member of the nasal device may be secured on the opposite side of the holder from where the nasal bases are positioned and along the generally vertical portion of the holder, relative to the placement limbs. There may be securing notches in the holder that help secure a nasal device to the holder at the point where the bases of the nasal device attach to the connecting member of the nasal device. The notches may allow a nasal device to be more securely attached to a nasal device holder.

In some embodiments, a nasal device may be made to be used a limited number of times, while other nasal devices may be made to be used only one time. Multiple nasal devices may be packaged and sold together. A nasal device attached to a nasal holder may be individually packaged in a pouch that is heat sealed, for instance. However, it is recognized that other suitable means for securely closing the pouch may be used, such as gluing. The holder may assist in inserting the nasal device into its corresponding pouch, as the holder can securely hold and stabilize the nasal device while being placed in the pouch, for example but not limited to, by machine. A plurality of pouches can then be packaged for sale in a box, or other suitable container, such as but not limited to a larger pouch, bag, carton, etc. For instance, one box may contain, for example, fourteen individually packaged nasal devices, each attached to holders, or any other suitable number of individually packaged nasal devices, each attached to holders. A holder can be sized and shaped to fit any size of nasal device. When a nasal device is coupled to a holder, it may be easier to retrieve the device from its pouch because the nasal device can be prone to twisting if it is not coupled to a holder. Additionally, when a nasal device is coupled to a holder for a nasal device, there is more surface area to grab. A holder can be sized and shaped to fit any size of nasal device.

FIG. 1 shows one embodiment of a holder for a nasal breathing air filtration or dilation device. Holder 100 may be generally "Z" or "S" shaped depending on which side of holder 100 is being viewed. However, in other embodiments, the holder 100 need not be "Z" or "S" shaped, and any other suitable shape may be used in order to secure a nasal device to the holder 100 in the manners disclosed herein. In the embodiment shown, nasal holder 100 may generally have one continuous curved edge that forms a body portion 110 and two placement limbs 120, 130, wherein body 110 is generally located between and connects placement limbs 120, 130. In other embodiments, the holder may be defined by several edges, including curved and/or straight edges, rather than a generally continuous edge, to generally form the body portion 110 and placement limbs 120, 130, and in some cases define a generally "Z" or "S" shaped holder. In one embodiment, holder 100 may have two sides 160, 170 which may generally be, but not necessarily be, longer than two ends 180, 190.

Securing notches 140, 150 may be formed where body portion 110 and placement limbs 120, 130 meet. Securing notches 140, 150 may be slits or notches that are formed toward the center of the holder from the sides 160, 170. In one embodiment, notches 140, 150 may be formed on opposite sides, as shown in FIG. 1. However, in other embodiments, the notches 140, 150 may be formed on the same side.

Figure 2:
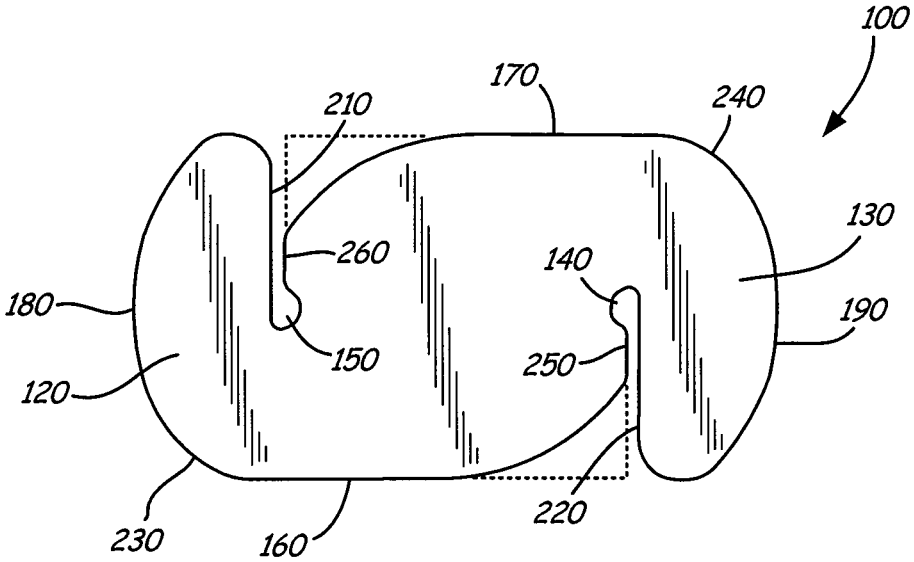
FIG. 2 is a top view of the holder of FIG. 1.
Figure 3:
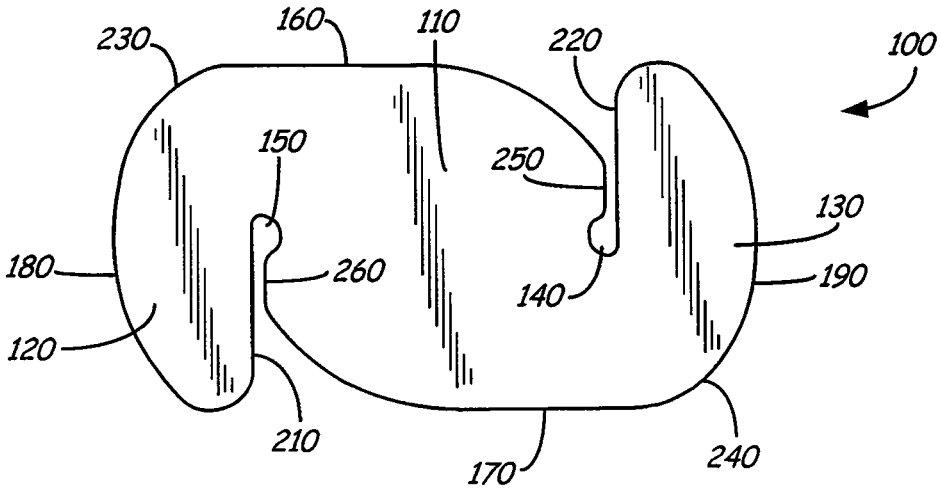
FIG. 3 is a bottom view of the holder of FIG. 1.

In one embodiment, holder 100 may include generally curved portions to conform to the shape of a nasal device in order to secure a nasal device, and to allow a nasal device that is coupled to the holder to be easily grabbed and held. FIGS. 2 and 3 show top and bottom views of one embodiment of holder 100 and the curvature about its perimeter. Ends 180, 190 may be generally curved to form an arc. In other embodiments, however, ends 180, 190 may be straight edges. Placement limb 120 may be formed by a curve that extends from one side 160 of holder 100 to the opposite side 170 of holder 100, and then forms a generally straight edge 210 into the holder and may be generally perpendicular to holder sides 160, 170. The straight edge 210 may form part of the notch 150, whereby placement limb 120 is generally distinguished from body portion 110 of holder 100. In a similar manner, placement limb 130 may be formed by a curve that extends from one side 170 of holder 100 to the opposite side 160 of holder 100, and then forms a generally straight edge 220 into the holder and may be generally perpendicular to holder sides 160, 170. The straight edge 220 may form part of the notch 140, whereby placement limb 130 is generally distinguished from body portion 110 of holder 100. Each side 160, 170 of holder 100 may include a shoulder portion 230, 240, where the holder 100 transitions from a side 160, 170 to an end 180, 190. In some embodiments, the placement limbs 120, 130 may be similarly shaped. However, in other embodiments, the placement limbs 120, 130 may be differently shaped.

Straight edges 210, 220 can be formed on opposite sides 160, 170 of holder 100 and extend inward approximately half, or other suitable distance, of the width of body 110 measured from side 160 to side 170 to form one side of the notches 140, 150. Opposing the straight edges, 210, 220, the holder may include corresponding straight edges or ridges 260, 250, which may be formed from inward from sides 160, 170. In one embodiment, as illustrated in FIGS. 2 and 3, sides 160 and 170 may curve inward toward ridges 250, 260, to provide a receiving area for a connecting member, or bridge, of a nasal device. In other embodiments, the sides 160, 170 may be generally straight edges which share a corner with its corresponding ridge 250, 260, as shown in phantom in FIG. 2. Ridges 260, 250 may be generally parallel to straight edges 210, 220. Straight edges 210, 220 and ridges 260, 250 may be connected through curved portions at the ends of notches 140, 150. These curved portions may be formed by an arc in body portion 110 and placement limbs 120, 130 that extends from the straight edges 210, 220 of placement limbs 120, 130 to the ridges 260, 250 of body portion 110. In other embodiments, the ends of notches 140, 150 may be of any other suitable shape such as polygonal, square, oval, rectangular, triangular, etc. Although not necessary, in some embodiments, the ends of notches 140, 150 may form an opening with a diameter, or width, that is larger than the width of the slit created between straight edges 210, 220 and corresponding ridges 250, 260. This allows the connecting member of a nasal device to be tightly passed through the slits between straight edges 210, 220 and corresponding ridges 250, 260, and securely held at the end of notches 140, 150.

The length of a holder 100 according to the present disclosure may be any suitable length for holding the appropriate nasal device. In some embodiments, the length of a holder 100 may be in the range of 25 mm to 75 mm, and preferably in the range of 30 mm to 50 mm, and may depend on the size of the nasal device. The width of a holder 100 according to the present disclosure may be any suitable width for holding the appropriate nasal device. In some embodiments, the width of a holder 100 may be in the range of 15 mm to 30 mm, and preferably in the range of 18 mm to 25 mm, and may depend on the size of the nasal device. The distance between the notches 140, 150 of a holder 100 according to the present disclosure may also be any suitable distance for holding the appropriate nasal device. In some embodiments, the distance between notches 140, 150 of a holder 100 may be in the range of 10 mm to 30 mm, and may depend on the length of the connecting member of the nasal device.

Figure 4:
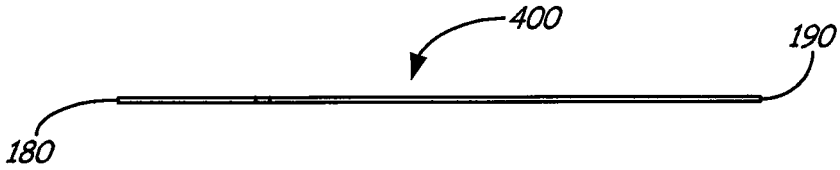
FIG. 4 is a side view of the holder of FIG. 1.
Figure 5:
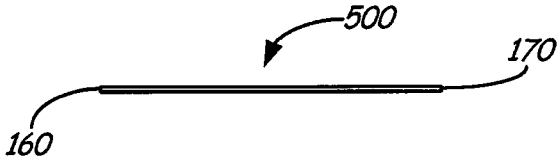
FIG. 5 is an end view of the holder of FIG. 1.

FIGS. 4 and 5 illustrate side and end views of one embodiment of a uniformly thin nasal device holder 100 according to the present disclosure. As can be seen, holder 100 may be relatively thin with respect to the length and width dimensions of the holder. In some embodiments, the thickness of the holder 100 may be generally described as paper-thin, and may be in the range of about 0.1 mm to about 2 mm, and preferably between about 0.3 mm and 1 mm. However, it is understood that any suitable thickness may be used, including those greater than 2 mm. Additionally, in other embodiments the thickness of the holder may not be uniform, and may vary across the holder as desired. For instance, but not limited by, the placement limbs may be thicker than the body portion to help secure the bases of the nasal device to the holder. In other embodiments, the area of the holder around the notches may be thicker than the rest of the holder to more securely hold the nasal device.

Figure 6:
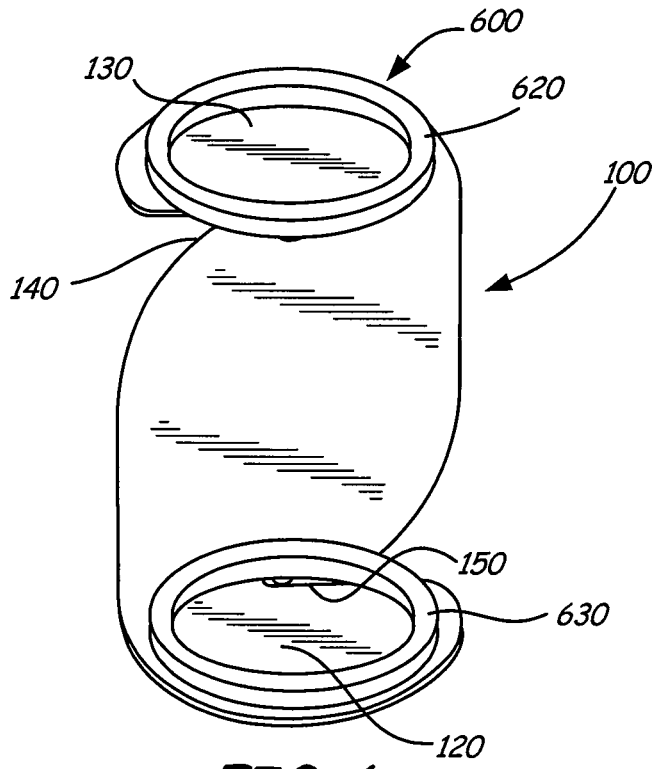
FIG. 6 is a top view of the holder for a nasal filtration or dilation device of FIG. 1 with a nasal device attached in accordance with one embodiment of the present disclosure.
Figure 7:
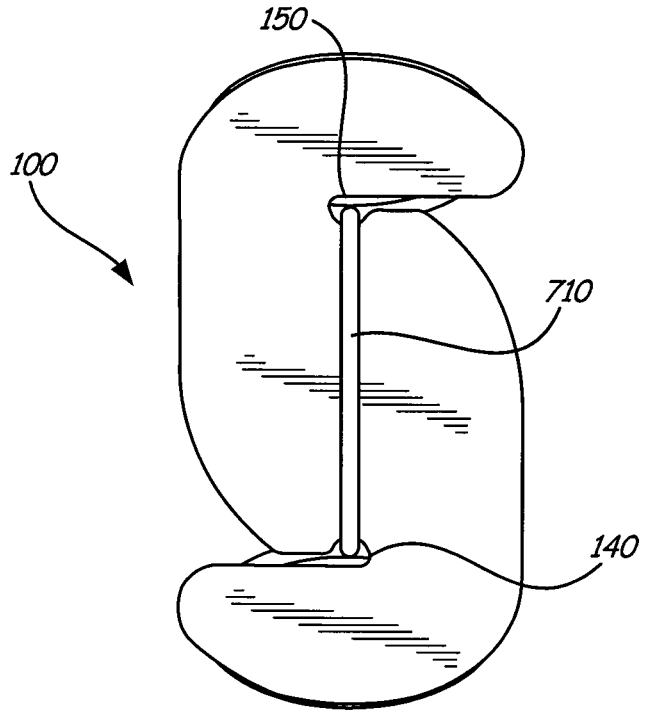
FIG. 7 is a bottom view of the holder for a nasal filtration or dilation device of FIG. 1 with a nasal device attached in accordance with one embodiment of the present disclosure.

FIGS. 6 and 7 show an embodiment of a holder 100 for a nasal device with a nasal device 600 secured thereto. The nasal device 600 may be secured to the holder 100 by sliding one end of a connecting member or bridge 710 into the slit created by straight edge 210 and ridge 260, and into the end of notch 150. Similarly, the other end of the connecting member or bridge 710 can be slid into the slit created by straight edge 220 and ridge 250, and into the end of notch 140. As shown in FIG. 6, each of two bases 620, 630 of nasal device 600 may be positioned adjacent, or proximate, a placement limb 120, 130 one a top side (or bottom side) of holder 100. As shown in FIG. 7, the connecting member 710 may rest on the bottom side (or top side) of holder 100, or in other words, the opposite side of the holder from nasal bases 620, 630. Securing notches 140, 150 may keep nasal device 600 securely attached to holder 100 and may keep the nasal device from becoming, for example, twisted, damaged, broken, etc. during packaging, shipping, storage, and/or handling.

FIGS. 8-12 illustrate another embodiment of the present disclosure, which is similar to the embodiment illustrated in FIGS. 1-5 with the differences discussed below. As shown in FIGS. 8-12, the ends of a nasal device holder 800, in the area of the placement limbs 820, 830, may have placement limb lips 815, 825, which may help hold nasal device bases securely in place on placement limbs 820, 830. The placement limb lips 815, 825 may project outward from a top face of the holder 800. Although not necessary, limb lips 815, 825 may project generally perpendicularly from the surface of the holder 800. In some embodiments, the limb lips 815, 825 may project from the surface of the holder 800 from about approximately 1 mm to approximately 5 mm. However, the placement limb lip may be project out to any suitable height. The lip 815 may extend around at least a portion of the outer perimeter of the placement limb 820. The lip 825 may extend around at least a portion of the outer perimeter of the placement limb 830. In yet other embodiments, a limb lip may extend around the entire perimeter of the holder 800. The lips may be comprised of the same material as the rest of the holder 800 such as any plastic, paper, or metal material, or the lips may be made of a different material from the rest of the holder 800. In some embodiments, the lips may be configured to be more rigid or more flexible than the rest of the holder.

Figure 8:
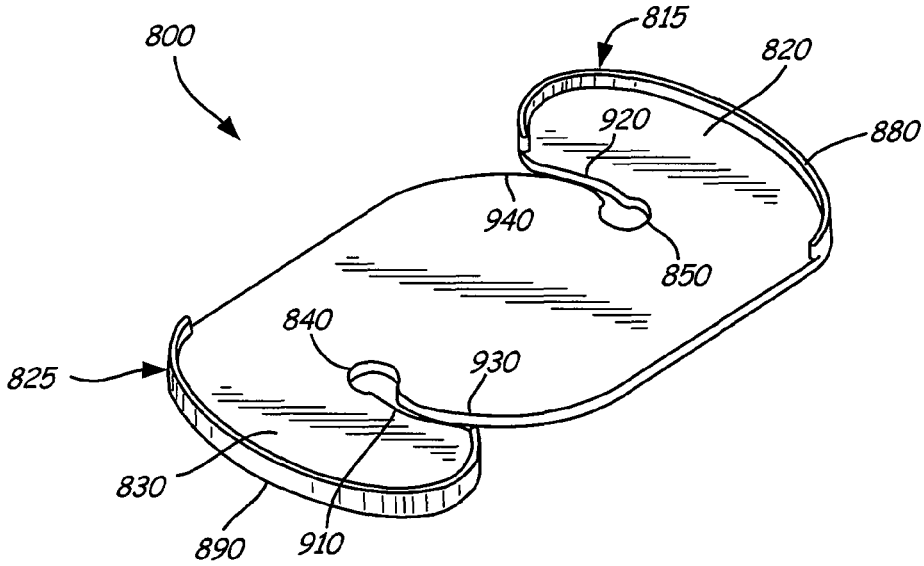
FIG. 8 is a perspective view of another embodiment of a holder for a nasal filtration or dilation device of the present disclosure.
Figure 9:
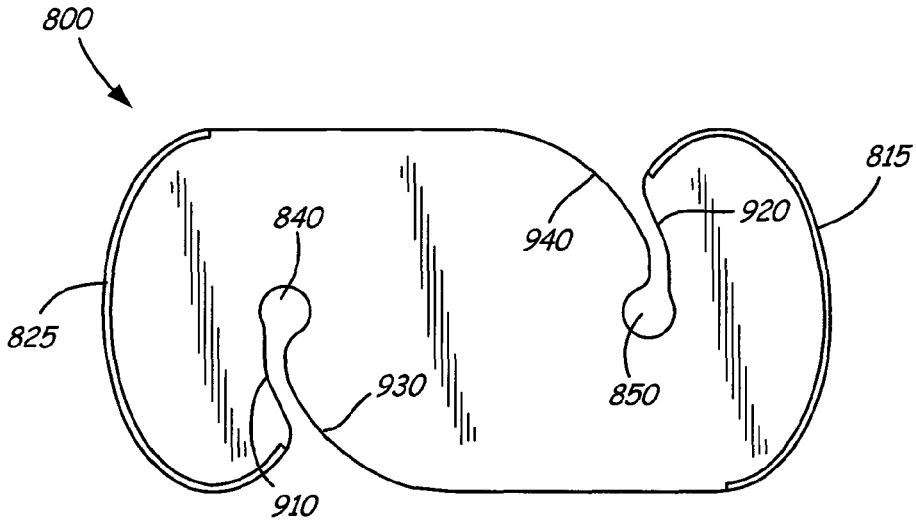
FIG. 9 is a top view of the holder of FIG. 8.
Figure 10:
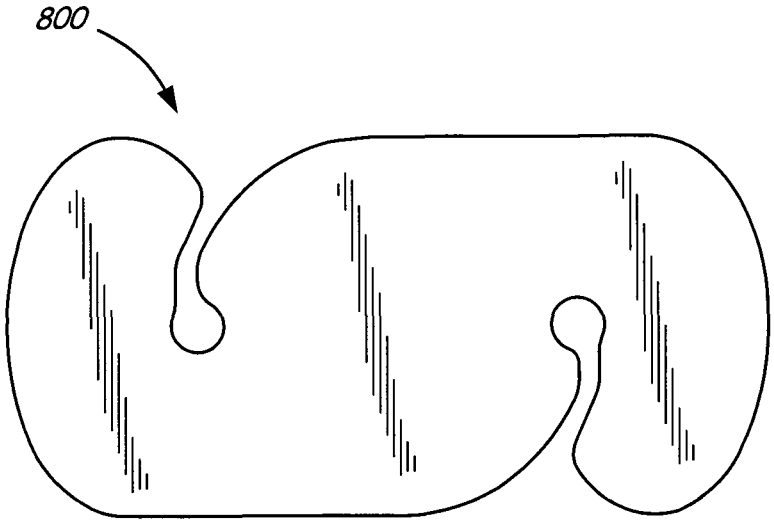
FIG. 10 is a bottom view of the holder of FIG. 8.
Figure 11:
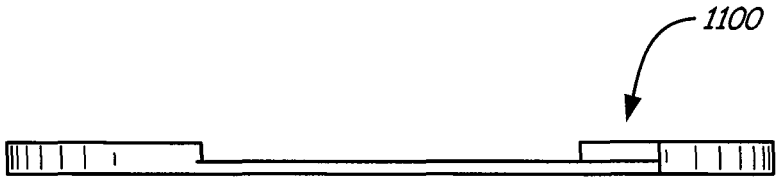
FIG. 11 is a side view of the holder of FIG. 8.
Figure 12:
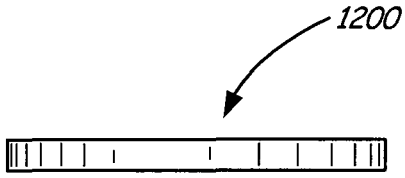
FIG. 12 is an end view of the holder of FIG. 8.

In some embodiments, rather than notches formed using straight edges, as illustrated in FIGS. 1-7, the slit of the notches 840, 850 may be formed by opposing curved edges 910, 930 and 920, 940 that are connected at their ends through curved portions at the ends of notches 840, 850. These curved portions may be formed by an arc that extends from curved edge 910 to curved edge 920 and an arc that extends from curved edge 930 to curved edge 940. In other embodiments, the ends of notches 840, 850 may be of any other suitable shape such as polygonal, square, oval, rectangular, triangular, etc. Although not necessary, in some embodiments, the ends of notches 840, 850 may form an opening with a diameter, or width, that is larger than the width of the slit created between curved edges 910, 930 and their corresponding opposing curved edges 930, 940. This allows the connecting member of a nasal device to be tightly passed through the slits between curved edges 910, 930 and 920, 940, and securely held at the end of notches 840, 850. FIGS. 8-10 illustrate but one additional example of notches that may be used according to the present disclosure. Any suitable configuration of notches that can secure a nasal device to the holder by passing the connecting member of the nasal device into the notches may be used.

Figure 13:
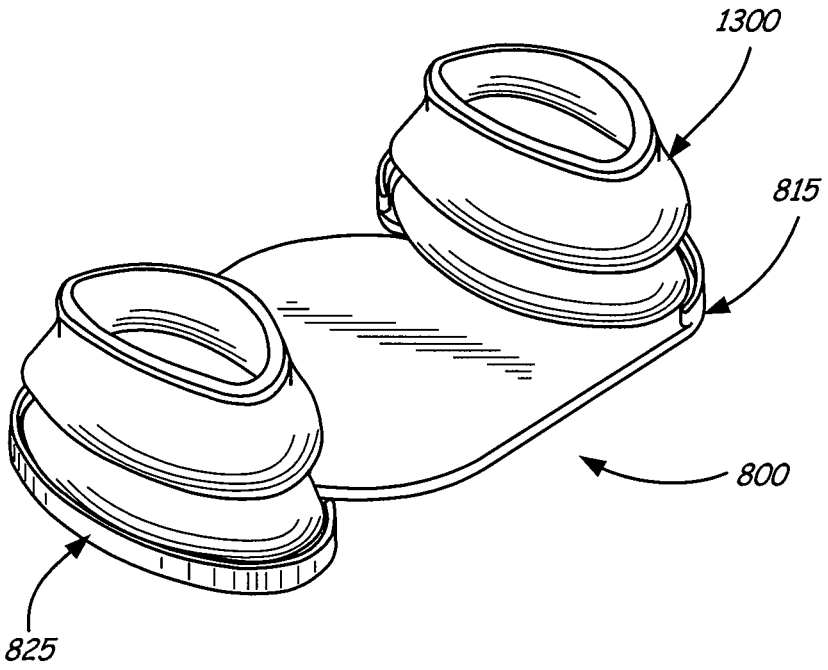
FIG. 13 is a top view of the holder for a nasal filtration or dilation device of FIG. 8 with a nasal device attached in accordance with one embodiment of the present disclosure.
Figure 14:
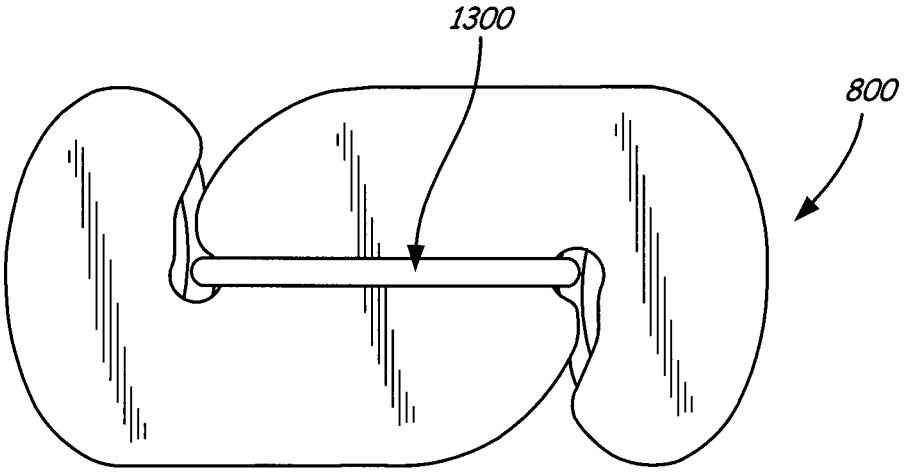
FIG. 14 is a bottom view of the holder for a nasal filtration or dilation device of FIG. 8 with a nasal device attached in accordance with one embodiment of the present disclosure.

FIGS. 13 and 14 show an embodiment of a holder 800 with placement limb lips 815, 825, which securely hold an embodiment of a nasal device 1300. A nasal device may be attached to holder 800 in generally the same manner as described above with respect to FIGS. 6 and 7. However, the limb lips 815, 825 may be used to secure a portion of the outer perimeter of the bases of the nasal device 1300 within the area of the holder 800.

Figure 15:
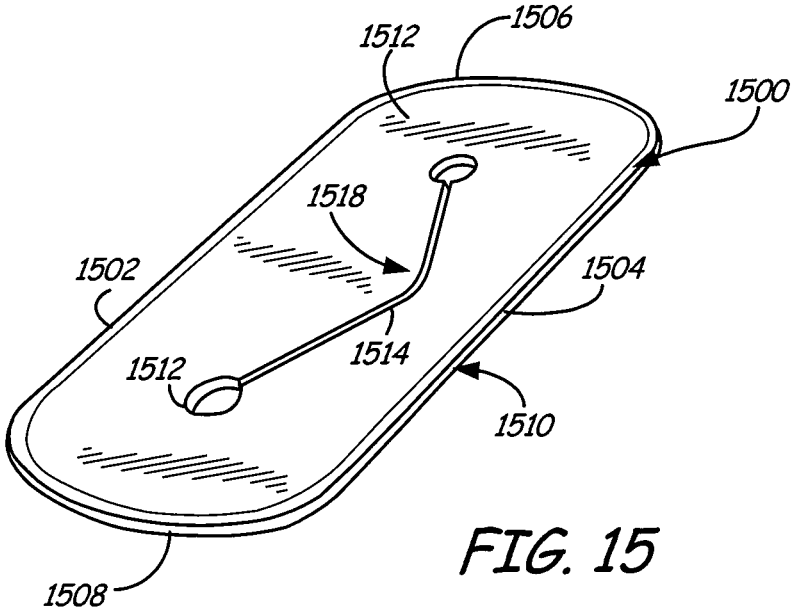
FIG. 15 is a perspective view of yet another embodiment of a holder for a nasal filtration or dilation device of the present disclosure.

FIG. 15 illustrates another embodiment of a nasal device holder 1500 of the present disclosure. The holder 1500 may generally have two sides 1502, 1504 and two ends 1506, 1508. The sides 1502, 1504 and ends 1506, 1508 may be defined by a generally continuous edge 1510. In one embodiment, the sides 1502, 1504 may be generally straight edges and the ends 1506, 1508 may be generally curved edges, for example but not limited to hemispherical. However, in other embodiments, any of the sides 1502, 1504 or ends 1506, 1508 may be straight edges or curved edges, or include portions that are both straight and curved, and may form any suitable shape holder, such as but not limited to rectangular, square, oval, circular, etc. In one embodiment, the holder may be longer in the direction of the sides 1502, 1504 than the holder is wide.

The holder 1500 may have two openings 1512 positioned within the body of the holder between the outer edge of the holder. The openings 1514 may be shaped as circles, squares, rectangles, ovals, triangles, etc., and in some embodiments may be shaped and sized differently from one another. The openings 1512 may be connected with one another with a slit 1514. In one embodiment, shown in FIG. 15, the slit may be generally "V" shaped. However, it is recognized, that slit 1514 may be any suitable shape, including but not limited to, a straight line, "W" shaped, curvy, "S" shaped, etc. The openings 1512 may have any suitable width or diameter, and in some cases may be determined by the size of the connecting member of the nasal device it is meant to secure. In one embodiment, the width of the slit 1514 may be less than the width or diameter of the openings 1512.

Figure 16:
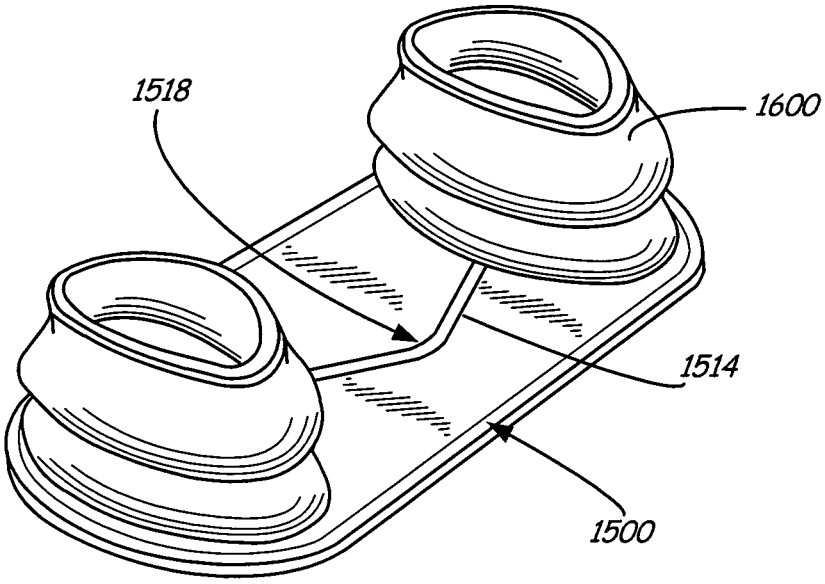
FIG. 16 is a perspective view of the holder for a nasal filtration or dilation device of FIG. 15 with a nasal device attached in accordance with one embodiment of the present disclosure.

In a further embodiment, the slit 1514 may create a flap 1518, which may be generally flexible, such that at least a portion of the slit can be widened to receive the connecting member of a nasal device 1600, as shown in FIG. 16. Accordingly, when flap 1518 is used to widen at least a portion of the slit 1514, a connecting member may be slid through slit 1514 and secured in openings 1512. Once the connecting member is secured in openings 1512, flap 1518 may be repositioned in its normal resting position such that slit 1514 is returned to its original width, thereby removably securing a nasal device 1600 to the holder 1500. As can be seen in FIG. 16, the bases of the nasal device 1600 may be secured proximate one side of the holder 1500 while the connecting member of the nasal device may be secured proximate the opposite side of the holder. Such an embodiment as illustrated in FIGS. 15 and 16 may be used to more easily fully automate the process of securing a nasal device to a holder, in order to more efficiently package the nasal device.

In general, by coupling a nasal device to a holder according to the present disclosure, more uniform and easier packaging may be possible. For example, but not limited to, each individual pouch having a nasal device secured to a holder may assume substantially the same shape and consume substantially the same amount of space. In contrast, if a nasal device is packaged in a pouch without a holder, the flexibility of a nasal device may permit the nasal device to assume a number of undesirable positions in the pouch, distorting the pouch in any number of different ways, which can make it more difficult to package a number of pouches together. Similarly, if nasal devices were not coupled to holders and therefore able to twist in many directions, heat-sealing the pouch may be more difficult as the bases or connecting member of the nasal holder might protrude past the end of the pouch to be heat-sealed and accordingly be improperly heat-sealed with the pouch thereby damaging the nasal device. Additionally, for embodiments of a nasal device that can be used more than a single time, a holder for a nasal device could be used to secure and protect a nasal device between uses. Without a holder for a nasal device, the nasal device might be lost, dirtied, and/or damaged. In some cases, this may lead to contamination and/or irritation of the nasal cavities when the nasal device is reused.

Although the various embodiments of the present disclosure have been described with reference to preferred embodiments, persons skilled in the art will recognize that changes may be made in form and detail without departing from the spirit and scope of the disclosure.

We claim:

1. A holder for a nasal device having two base portions coupled by a connecting member extending between the base portions, the holder comprising:

one or more contiguous edges defining a body portion and two placement limbs and defining a top and bottom surface of the holder;

a placement notch defined by the one or more contiguous edges between the body portion and each of the placement limbs, the notches each configured as a slit having a first width extending into the body portion and terminating with an opening of a second width larger than the first width, the notches configured to releasably secure the nasal device to the holder, such that the two base portions of the nasal device are secured proximate the top surface of the holder and the connecting member of the nasal device extends proximate the bottom surface of the holder between the notches.

2. The holder of claim 1, wherein the holder is made of thermoplastic.

3. The holder of claim 2, wherein the thermoplastic is a polyethylene terephthalate.

4. The holder of claim 1, wherein the one or more contiguous edges comprises a single continuous edge.

5. The holder of claim 1, wherein at least a portion of a perimeter of each placement limb comprises a lip that projects from the top surface of the holder.

6. The holder of claim 5, wherein the lip projects between 1 mm and 5 mm from the top surface of the holder.

7. A combination nasal device and nasal device holder comprising:

a nasal device comprising two base portions and a connecting member connecting the two base portions; and a holder for releasably securing the nasal device, the holder comprising:

a perimeter defining at least one notch for releasably receiving the connecting member of the nasal device so as to releasably secure the two base portions of the nasal device proximate a first side of the holder, with the connecting member proximate a second side of the holder.

8. The combination nasal device and nasal device holder of claim 7, wherein the holder comprises two notches for releasably receiving the connecting member with the connecting member extending proximate the second side of the holder between the two notches.

9. The combination nasal device and nasal device holder of claim 8, wherein the holder further comprises a lip that projects from the top surface of the holder and extends around at least a portion of an outer perimeter of the holder.

10. The combination nasal device and nasal device holder of claim 9, wherein the holder further comprises a second lip that projects from the top surface of the holder and extends around at least a portion of an outer perimeter of the holder.

11. The combination nasal device and nasal device holder of claim 10, wherein the base portions of the nasal device are secured to the holder such that the lips surround at least a portion of the base portions.

12. The combination nasal device and nasal device holder of claim 11, wherein the lips project between 1 mm and 5 mm from the top surface of the holder.

13. The combination nasal device and nasal device holder of claim 7, wherein the holder is made of a thermoplastic.

14. The combination nasal device and nasal device holder of claim 13, wherein the thermoplastic is a polyethylene terephthalate.

15. A combination nasal device and nasal device holder comprising:

a nasal device comprising two base portions coupled by a connecting member extending between the base portions; and a holder for removably securing the nasal device, the holder comprising:

a perimeter defining a body portion;

two openings through the holder located within the body portion; and a slit connecting the two openings for releasably receiving the connecting member of the nasal device.

16. The combination nasal device and nasal device holder of claim 15, wherein the slit defines a generally flexible flap in the body portion between the two openings.

17. The combination nasal device and nasal device holder of claim 15, wherein the holder is made of thermoplastic.

18. The combination nasal device and nasal device holder of claim 17, wherein the thermoplastic is a polyethylene terephthalate.

19. The combination nasal device and nasal device holder of claim 15, wherein the slit is non-linear.

* * * * *